US006340183B1

(12) United States Patent
Ramsauer

(10) Patent No.: US 6,340,183 B1
(45) Date of Patent: Jan. 22, 2002

(54) BOLT LOCK FOR MOUNTING IN A THIN WALL

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/413,306

(22) Filed: Oct. 6, 1999

(30) Foreign Application Priority Data

Oct. 7, 1998 (DE) ..... 298 17 875 U

(51) Int. Cl.[7] ..... E05C 1/10
(52) U.S. Cl. ..... 292/175; 292/DIG. 64
(58) Field of Search ..... 292/175, 164, 292/DIG. 31, DIG. 64

(56) References Cited

U.S. PATENT DOCUMENTS 682,959 A * 9/1901 Seng ..... 292/175
1,675,591 A * 7/1928 Bell ..... 292/175
3,346,289 A * 10/1967 Anderson ..... 292/175
3,671,065 A * 6/1972 Bingham ..... 292/175
3,841,674 A * 10/1974 Bisbing ..... 292/175
5,193,707 A * 3/1993 Mizumura ..... 220/326
5,671,958 A * 9/1997 Szapucki ..... 292/175
5,934,716 A * 8/1999 Koveal ..... 292/175

* cited by examiner

*Primary Examiner*—Gary Estremsky
(74) *Attorney, Agent, or Firm*—Reed Smith LLP

(57) ABSTRACT

The description relates to a bolt lock for mounting in a thin wall, such as a sheet metal cabinet door, comprising a handle plate which can snap into a rectangular cutout in the thin wall and which has, at one side of the rectangle, a bolt that is supported so as to be displaceable against spring force relative to the thin wall, wherein, the bolt is formed by a second plate which is supported so as to be displaceable against the spring force in the first plate which is held in the thin wall.

20 Claims, 3 Drawing Sheets

BOLT LOCK FOR MOUNTING IN A THIN WALL

BACKGROUND OF THE INVENTION a.) Field of the Invention

The invention is directed to a bolt lock for mounting in a thin wall, such as a sheet metal cabinet door, comprising a handle plate which can snap into a rectangular cutout in the thin wall and which has, at one side of the rectangle, a bolt that is supported so as to be displaceable against spring force relative to the thin wall. While the foregoing description and drawings represent the present invention, it will be obvious to those skilled in the art that various changes may be made therein without departing from the true spirit and scope of the present invention.

A bolt lock of this kind is known to the present Applicant from Brochure Sheet G-9 by Southco, U.S.A. A bolt lock of the type mentioned above can snap into a suitably dimensioned opening in a door leaf, whereupon the door or flap can be pushed closed, wherein the bolt engages behind a case or frame to which the door is hinged. When the door or flap is pushed closed, the handle plate is displaced inside of the correspondingly dimensioned right-angled opening in the door leaf against the force of a spring which is articulated at the handle plate and which presses against the edge of the opening, wherein, as a result of the inclined surface of the bolt, this displacing movement is carried out automatically when the door or flap is pushed closed. As soon as the bolt engages behind the case or frame, the spring presses the handle plate in the opposite direction and accordingly locks the door at the door frame.

The known lock is available in different constructions for defined thicknesses, e.g., 1.2 mm, 1.6 mm and 2.2 mm, of the door leaf. Deviations in thickness greater than 0.2 mm are not permissible because the arrangement would then jam or rattle.

Nevertheless, the lock described above has the advantage that it can be mounted in a door leaf without the need for its rear side to be accessible. In other known locks for sheet metal cabinet doors or flaps, mounting requires access to the rear side of the door leaf so that a lock inserted through a corresponding opening in the door leaf from the front can be fastened to the rear side by means of a nut or an attachable spring part.

OBJECT AND SUMMARY OF THE INVENTION

It is the primary object of the invention to further develop a bolt lock of the type mentioned above in such a way that it does not require a separate series for every thickness of sheet metal, but rather can be adapted to a relatively large range of different sheet metal thicknesses without impeding operation or rattling.

The above object of the invention is met in that the bolt is formed by a second (inner) handle plate which is supported so as to be displaceable against spring force in the first (outer) plate which is held in the thin wall.

As a result of this step, the movability of the plate supporting the bolt is no longer influenced by the sheet metal thickness holding the outer plate; rather, the arrangement can be further developed such that it can be securely fastened in thin walls having a relatively large variation in wall thickness.

In order to fix this first, outer plate in the rectangular opening of the wall such as a door leaf, the plate has, at least at one side wall, a projection which projects beyond the outer wall plane and which can be deflected back against spring force when the plate is pressed into the sheet metal cutout in the wall plane and which forms a projection tip which contacts the inside of the sheet metal wall in a clamping manner when pressed in. As a result of this feature, the plate can snap into the rectangular cutout of the thin wall from the front without the need for the rear side of the thin wall to be accessible. The plate need not be displaceable in the rectangular cutout as in the prior art, so that the plate can be held in the wall by relatively large spring forces and friction coefficients, which benefits the stability of the arrangement.

Due to the fact that the second plate is mounted in the first plate so as to be displaceable against spring force, it is possible to guarantee optimum displaceability by ensuring a support which is extensively free of play, but which has sufficient ability to slide. The second plate, which can be received inside the first plate in a sliding manner, can be exchanged, if necessary, in order to adapt the bolt offset to different thicknesses of the door frame, for example. The outer plate can also be exchanged, if necessary, in case of a large variation in door thickness ranges.

According to a further development of the invention, the first plate can form an opening in the side wall at the side facing the bolt, wherein the second plate with the bolt supported by the second plate projects through this opening in a displaceable manner. The bolt lock can advantageously be arranged in such a way that the first plate forms an edge at the upper end of the side wall remote of the bolt, which edge projects into the inner cavity of the first plate until it forms a rear grip surface for opening the door, or the like, at least when the second plate is pulled back or deflected back into the first plate. In this case, no additional handle need be provided for opening the door (for which purpose, two hands would be required under certain conditions). Rather, the finger used to push back the second plate into the unlocked position, possibly after unlocking displacement, can engage behind this rear grip surface and exert a pulling force for swinging open the door.

According to yet another development of the invention, the first plate forms a cover which projects outward over the side walls of the plate on all sides and rests on the edge of the opening after the plate has been inserted into the opening in the thin wall. The rectangular cutout, which may have sharp edges, is covered by means of this step. The cover preferably has an opening for access to the second plate, this opening being arranged in such a way that it forms the rear grip surface for opening the door, or the like, when the second plate is deflected back.

The two side walls of the first plate which lie opposite one another and advisably form a slide guide for the second plate have two notches which face away from the cover plane vertically and enclose a tongue with a holding surface extending into the vicinity of the lower cover edge surface. In this way, there is a holding projection on both sides of the plate, which benefits the stability of the arrangement.

Alternatively, the side wall of the first plate lying opposite the bolt can also form notches facing away from the cover plane vertically, these notches enclosing a tongue which extends into the vicinity of the lower cover edge surface.

In this case, the fastening is carried out at another location, but one which can likewise ensure adequate stability.

This applies in particular when the first, outer plate at the side facing the bolt forms two shoulders which extend diagonally upward in the direction of the thin wall from the end faces of the two side walls perpendicular to this side and which terminate close to the plane of the thin wall so as to receive the bolt between them in a sliding manner. These shoulders contact the rear surface of the thin wall when the plate is inserted into the cutout at an inclination and thus ensure a secure hold at this location, which results in a highly stable arrangement.

These shoulders can be constructed in a suitable manner so as to be flexible in order to adapt to different sheet metal thicknesses to a determined extent.

Similarly, it is possible to adapt to different sheet metal thicknesses in that the free end of the tongues forms an inclination, which can also be provided with ribs, such that this inclination contacts the lower edge of the opening in the thin wall and accordingly securely locks the plate in the opening even when the thickness of the thin wall varies.

It is advantageous when a pressure spring such as a helical spring is arranged between the outer surface of the wall of the inner plate remote of the bolt and the inner surface of the wall of the outer plate remote of the bolt. In this way, the inner plate is pressed in its locking position, so that the bolt works as a door latch. In order to hold the spring in place, it can be advantageous when a shoulder for receiving one end of the helical spring is provided on the outer surface of the wall of the inner plate remote of the bolt. This shoulder can have a circular shape or can be cross-shaped in cross section, which is advantageous for technical reasons pertaining the injection molding.

The base of the outer plate can have an opening into which a shoulder projecting from the base of the inner plate can extend in such a way that it defines the thrusting or translational movement of the inner plate into the outer plate at least in the direction of the bolt. This prevents the bolt from being completely pressed out of the outer plate through the spring force under certain conditions. This shoulder is advisably ramp-shaped in longitudinal section, the sloping line of the ramp being directed away from the bolt. This means that the two plates can be mounted one inside the other without the need for special handling, but are then locked one inside the other so that they cannot come apart while being transported or when mounting in a door leaf.

The spring which reinforces the latch operation of the bolt can serve at the same time to support the tongue which holds the outer plate inside the thin wall, so as to reduce the risk that its spring force will decrease excessively over the course of time, which can happen in many plastics.

The invention will be explained more fully in the following with reference to embodiment examples shown in the drawings.

DESCRIPTION OF THE PREFERRED EMBODIMENT

Figure 1A:
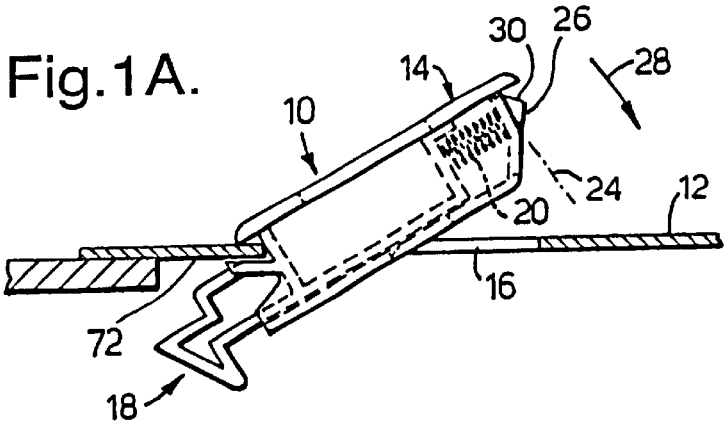
FIGS. 1A, 1B, 1C and 1D show a bolt lock constructed according to the invention in connection with a door leaf in different mounting positions.
Figure 1B:
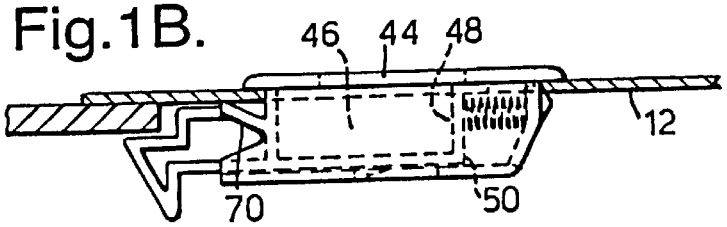
Figure 1C:
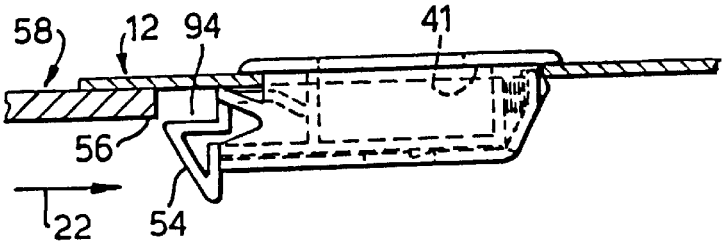
Figure 1C:
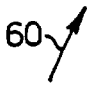

FIG. 1A shows a bolt lock 10 which can be mounted in a thin wall such as a sheet metal cabinet door 12 or flap, wherein the bolt lock 10 is formed of a first, outer handle plate 14 which can snap into a rectangular cutout 16 in the thin wall 12, and a second, inner handle plate or bolt device 18 which is mounted in the first, outer handle plate 14 so as to be displaceable against the force of a spring 20 opposite the direction indicated by the arrow 22 (FIG. 1C).

Figure 2A:
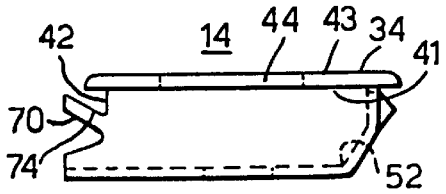
FIGS. 2A, 2B and 2C show three different views of the first (outer) plate of the bolt lock according to FIGS. 1A to 1D, which plate forms the outer housing.

As is shown in FIG. 1A, the outer handle plate or housing 14 has a projection 26 at the right-hand side with reference to FIG. 1A. This projection 26 projects over the outer wall plane 24 and, when pressed into the plate 14 in the cutout 16 of the thin wall 12 (see arrow 28), can deflect back into this wall plane 24 against the force of a spring, for which spring 20 can also be used, and forms a projection face 30 which, when pressed in, contacts the back surface or the edge of the cutout 16 of the thin wall 12 in a clamping manner as can be seen in FIG. 1B. The first plate or housing 14 forms an opening 32 (see also FIG. 2C) at the left-hand side, as shown in FIG. 1A, from which the bolt device 18 emerges and through which the second or inner handle plate 18 extends so as to be displaceable. The first handle plate or housing 14 further forms a cover 34 which projects over the side walls 36, 38, 40, 42 (see FIGS. 2A, 2B and 2C), so that, as can clearly be seen in FIG. 1B, this cover edge which projects out on all sides covers the edge of the cutout 16 after the housing 14 is introduced into the cutout 16 according to FIG. 1A.

Figure 3A:
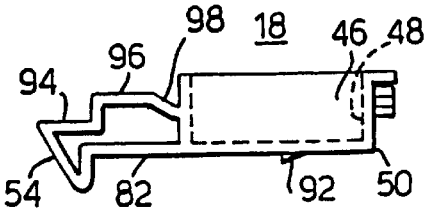
FIGS. 3A and 3B show two different views of the second (inner) plate forming the bolt.

Further, the cover 34 has an opening 44 which is sufficiently large to allow, e.g., one finger to reach through and to access the second, inner plate or bolt part 18, that is, the interior of the plate designated by 46 in FIG. 3A. The opening 44 is arranged in the cover 34 in such a way that the rear plate wall 48 according to FIG. 1B lies in the area of this opening 44 and can therefore be touched when reaching through with a finger and can be pressed against this wall 48. By pressing in this manner, the second plate 18 inside the first plate 14 can be displaced in a sliding manner against the force of the spring 20 until the position according to FIG. 1C is reached. At this point, the rear lower outer edge 50 of the second plate 18 strikes the somewhat inclined lower inner wall 52 of the first plate 14, so that a stop is formed for the movement in the direction of arrow 22.

Figure 1D:
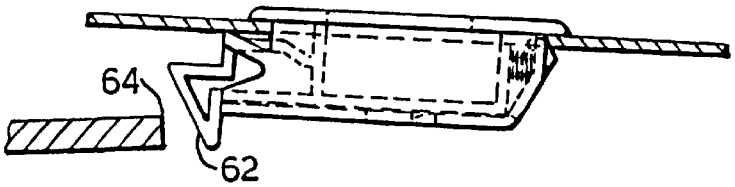

The locking latch 54 is released from a rear grip surface 56 formed by a door frame 58 or the like by means of this displacement. Accordingly, the door leaf 12 can be taken out of or swung out of the door frame 58 (or the flap 12 can be taken out of or swung out of a machine housing 58 or the like) as is shown in FIG. 1D by arrow 60.

Figure 4A:
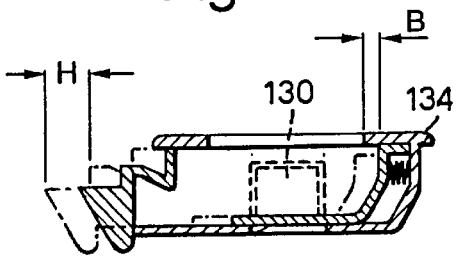
FIGS. 4A, 4B and 4C show three different views of an alternative embodiment form of the bolt lock.
Figure 4B:
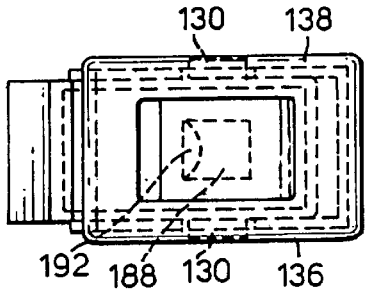
Figure 4C:
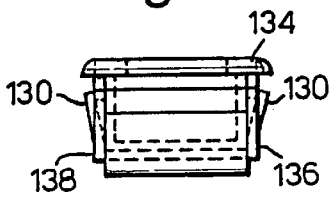
Figure 5:
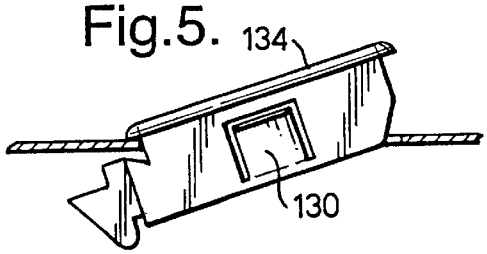
FIG. 5 shows a side view of the bolt lock according to FIGS. 4A to 4C during the installation process.
Figure 6:
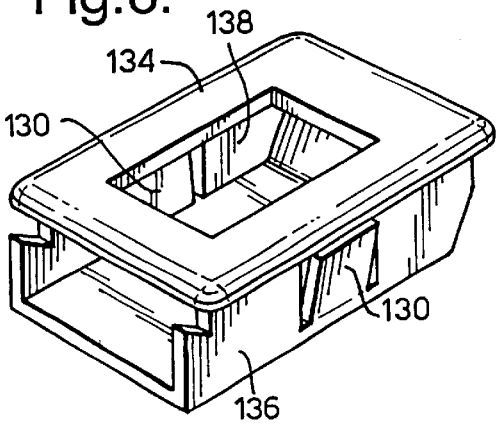
FIG. 6 shows a perspective view of the outer plate (housing) of the lock according to FIGS. 4A to 4C.
Figure 7:
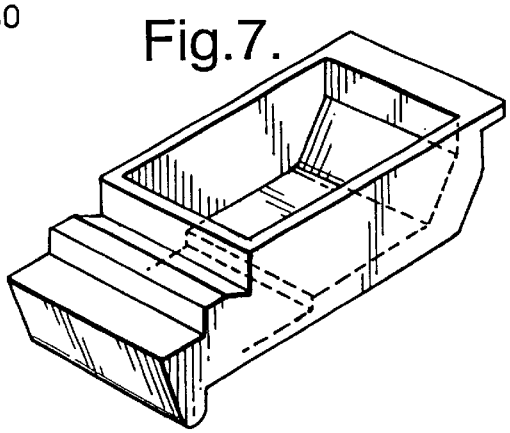
FIG. 7 shows a perspective view of the second (inner) plate of the bolt lock according to FIGS. 4A to 4C.

The size and position of the opening 44 in the cover 34 is advisably determined in such a way that a strip 43 is formed which projects into the inner cavity of the plate 14 and forms a rear grip surface 41 for opening the door 12 or the like, which rear grip surface 41 is accessible at least—and advisably only—when the second plate 18 is located inside of the first plate 14 in the receded position according to FIG. 10. It is sufficient for the strip to have a rear grip surface width B (see FIG. 4A) which makes up approximately half of the travel distance H, that is, the movement path of the second plate inside of the first plate, which is limited by stop 52 or 90, respectively. For example, with dimensions of the arrangement in the range of 25 to 30 mm for the cover width and 50 to 60 mm for the cover length, a travel distance H equaling 5 to 7 mm, e.g., H=6 mm, has proven successful, so that dimension B would be about 3 mm. The depth of the plates should be between 10 and 15 mm in order to make it possible to reach inside comfortably. The dimensions in FIGS. 4A, 4B and 4C are likewise only given by way of example.

When the door 12 is pushed closed, the inclination 62 of the latch 54 contacting the edge 64 of the door frame 58 makes it possible for the second plate to be pushed back automatically against the force of the spring, whereupon the second plate or bolt 54 is slid into the position shown in FIG. 1B by the force of the spring so that the door is locked.

Figure 3B:
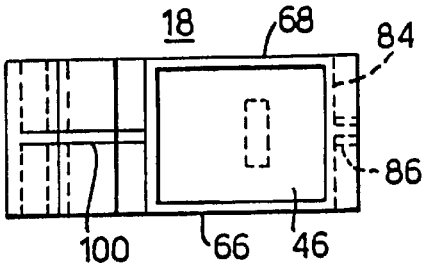

For purposes of the smooth running of this translational movement in the direction of arrow 22 and opposite thereto, the two opposite side walls 36, 38 of the first plate 14 form a slide guide for the second, inner plate 18 in that the inner surfaces of the side walls 36, 38 of the outer plate engage with slight play at the outer surfaces of the corresponding side walls 66, 68 of the second plate 18 (see FIG. 3B). The rest of the "side walls" 42 formed by the end faces of the walls 36, 38 of the outer plate 14 have shoulders 70 which extend diagonally upward in the direction of the thin wall 12 and which terminate close to the lower plane 72 of the thin wall and accordingly secure the outer plate 14 inside the cutout 16.

The sloping surface 74 according to FIG. 1 makes it possible for the plate 14 to be inserted diagonally into the cutout 16 and enables the subsequent swiveling in the direction of arrow 28 (see FIG. 1B). During this swiveling movement, the shoulder 70 is advisably pressed downward in a slightly springing manner so as to form a holding device for the plate 14, which holding device forms a frictional engagement and exerts a certain pressure. This springing action makes it possible to adapt in the desired manner to any differences in thickness of the thin wall 12 which may range between 0.8 mm and 2.3 mm, for example, On the opposite wall plane 24, the inclined surface 30 provides for adapting to different wall thicknesses of the wall 12 in that the surface 30 is swiveled outward to a greater or lesser extent, depending on the wall thickness of the surface 30, due to its inherent springing action. The holding action of the projection surface 30 can be reinforced by ribs which are formed thereon and which are indicated in FIG. 2C by reference number 76.

Figure 2B:
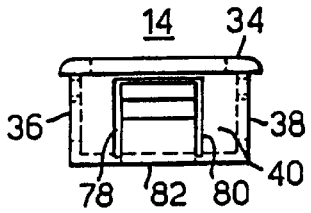
Figure 2C:
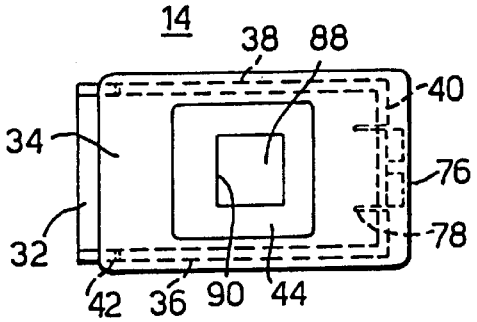

In order to provide the projection 26 with the springing action described above, the wall 40 located opposite the bolt latch 54 is provided, according to FIG. 2B, with two notches 78, 80 facing away from the plane of the cover 34 vertically, resulting in a tongue which joins at the base 82 of the plate 14 and which exhibits a springing action by reason of its material (plastic) and therefore makes it possible at the upper end of this tongue which carries the projection 26 to deflect back into the interior of the plate 14 and accordingly to insert the plate 14 into the cutout 16 of the thin wall 12 according to FIG. 1A. A shoulder 86 which proceeds from the wall 84 remote of the bolt latch 54 and on which the helical spring 20 can be mounted in a suitable manner serves, for example, to hold the helical spring 20 according to FIG. 1A in the position shown in this Figure. The shoulder 86 is ouffitted with a cross-shaped (instead of a circular) cross section in this case for technical reasons pertaining to injection molding.

The other end of the helical spring 20 is supported on the inner surface of the wall 52 of the outer plate 14, namely, as was already mentioned, in the area of the tongue carrying the projection 76, so as to reinforce its springing action, which it already possesses because of its material properties, as was already mentioned.

This prevents a reduction in the material spring action due to material fatigue.

The base 82 of the outer plate 14 has an opening 88 whose edge 90 which is directed toward the latch end 54 cooperates in such a way with a shoulder 92 projecting from the base 82 of the inner plate 18 that the translational movement of the inner plate 18 inside the outer plate 14 in the direction of the bolt 54 (opposite the direction of arrow 22 in FIG. 1C) is limited in a position which is shown in FIG. 1B. In this way, the inner plate 18 is prevented from sliding out of the outer plate 14 completely. The shoulder 92 is advisably shaped as a ramp in longitudinal section, wherein the sloping line of the ramp is directed away from the latch 54. This makes it possible for the inner plate 18 to slide into the outer plate 14 more easily when the bolt lock is assembled. The shape of the latch 54, especially the offset or receiving area 94 formed by this latch 54 (see FIG. 1C), can be adapted to the thickness of the frame 58. In particular, it is possible to keep inner plates 18 with differently shaped notches 94 in stock and to combine them with the outer plate 14 as needed. In this case, a standardized larger shape of the outer plate 14 in which differently shaped inner plates 18 are inserted can be used for different thicknesses of the frame 58.

While the can-shaped part 46 of the inner plate 18 supported inside the outer plate 14 has thin walls, e.g., of injection-molded plastic, the latch 54 is formed in that the base 82 continues forward, veers downward, forms the slope 54 and then the offset area for receiving the frame 58 and, finally, passes into a straight-line surface 96 which then veers back again at 98 in adapting to the slope of the shoulders 70 (see FIG. 1B). These multiply-bent portions are reinforced by an inner wall 100 extending vertical thereto.

FIGS. 4A to 4C show an alternative embodiment form in which fastening tongues with beveled projection surfaces 130 proceed from the side walls 136, 138. For the rest, the arrangements are carried out similarly to those described above.

What is claimed is:

1. A bolt lock for mounting in a thin wall with a rectangular cutout, such as a sheet metal cabinet door, comprising:

a handle plate acting as a first plate which can snap into the rectangular cutout in the thin wall;

said handle plate having a bolt for engaging at one side of the rectangular cutout, that is supported so as to be displaceable against spring force relative to the thin wall; and said bolt being formed by a second plate which is supported so as to be displaceable against the force of a spring in the first plate which is adapted to be held in the thin wall and;

wherein the first plate at the side facing the bolt forms two shoulders which are adapted to extend diagonally upward in the direction of the thin wall from the end faces of the two side walls perpendicular to said side facing the bolt and which are adapted to terminate close to the plane of the thin wall s o as to receive the bolt between the two shoulders in a sliding manner.

2. The bolt lock according to claim 1, wherein the first plate has, at least at one side wall, a projection which projects beyond an outer wall plane and which can be deflected back against spring force when the first plate is pressed into the rectangular cutout of the thin wall and which forms a surface contacting the inner surface or edge of the rectangular cutout in a clamping manner when pressed in.

3. The bolt lock according to claim 1, wherein the first plate forms an opening in said side facing the bolt, wherein the second plate with its bolt projects through said opening in a displaceable manner.

4. The bolt lock according to claim 3, wherein the first plate forms an edge at the upper end of a side wall remote of the bolt, which edge projects into the inner cavity of the first plate until it forms a rear grip surface for opening the door when the second plate is deflected back.

5. The bolt lock according to claim 3, wherein the first plate forms a cover which projects outward over the side walls of the first plate on all sides and, after being pressed into the cutout in the thin wall, rests on the edge of the cutout.

6. The bolt lock according to claim 5, wherein the cover has an opening for access to the second plate, which opening is arranged in such a way that it forms the rear grip surface for opening the door when the second plate is deflected back.

7. The bolt lock according to claim 1, wherein the two side walls of the first plate which lie opposite one another and form a slide guide for the second plate have two notches which face away from the cover plane vertically and enclose a tongue with holding surfaces extending into the vicinity of a lower cover edge surface.

8. The bolt lock according to claim 1, wherein the side wall of the first plate lying opposite the bolt forms notches facing away from a cover plane vertically, said notches enclosing a tongue which extends into the vicinity of a lower cover edge surface.

9. The bolt lock according to claim 1, wherein the free end of a tongue forms an inclination, which is provided with ribs, such that this inclination contacts the lower edge of the cutout in the thin wall and securely locks the first plate in the cutout.

10. The bolt lock according to claim 9, wherein a helical spring is arranged between the outer surface of the wall of the second plate remote of the bolt and the inner surface of the wall of the first plate remote of the bolt.

11. The bolt lock according to claim 1, wherein the outer surface of the wall of the second plate remote of the bolt has a shoulder for receiving one end of the helical spring.

12. The bolt lock according to claim 9, wherein a pressure spring is supported at the tongue serving to lock the first plate inside the cutout and reinforces its springing action.

13. The bolt lock according to claim 1, wherein a base of the first plate has an opening into which a shoulder projecting from the base of the second plate extends in such a way that it limits the translational movement of the second plate inside the first plate at least in the direction of the bolt.

14. The bolt lock according to claim 1, wherein a shoulder has the shape of a ramp in longitudinal section, wherein the sloping line of the ramp is directed away from the bolt.

15. The bolt lock according to claim 1, wherein a second plate with a locking device adapted to the shape of a door frame is used in an outer plate.

16. A bolt lock for mounting in a thin wall with a rectangular cutout, such as a sheet metal cabinet door, comprising:

a handle plate acting as a first plate which can snap into the rectangular cutout in the thin wall;

said handle plate having a bolt for engaging at one side of the rectangular cutout, that is supported so as to be displaceable against spring force relative to the thin wall; and said bolt being formed by a second plate which is supported so as to be displaceable against the force of a spring in the first plate which is adapted to be held in the thin wall, and;

wherein a side wall of the first plate lying opposite the bolt forms notches facing away from a cover plane vertically, said notches enclosing a tongue which extends into the vicinity of a lower cover edge surface.

17. The bolt lock according to claim 16, wherein the first plate forms an opening in the side wall at the side facing the bolt, wherein the second plate with its bolt projects through said opening in a displaceable manner.

18. The bolt lock according to claim 17, wherein the first plate forms an edge at the upper end of the side wall remote of the bolt, which edge projects into the inner cavity of the first plate until it forms a rear grip surface for opening the door when the second plate is deflected back.

19. A bolt lock for mounting in a thin wall with a rectangular cutout, such as a sheet metal cabinet door, comprising:

a handle plate acting as a first plate which can snap into the rectangular cutout in the thin wall;

said handle plate having a bolt for engaging at one side of the rectangular cutout, that is supported so as to be displaceable against spring force relative to the thin wall; and said bolt being formed by a second plate which is supported so as to be displaceable against the force of a spring in the first plate which is adapted to be held in the thin wall;

wherein the free end of a tongue forms an inclination, which is provided with ribs, such that this inclination contacts the lower edge of the cutout in the thin wall and securely locks the first plate in the cutout, and;

wherein the spring is supported at the tongue serving to lock the first plate inside the cutout and reinforces its springing action.

20. The bolt lock according to claim 16, wherein the first plate has, at least at one side wall, a projection which projects beyond the outer wall plane and which can be deflected back against spring force when the first plate is pressed into the rectangular cutout of the thin wall in the wall plane and which forms a surface contacting the inner surface or edge of the rectangular cutout in a clamping manner when pressed in.

* * * * *